US011346195B2

(12) United States Patent
Balan et al.

(10) Patent No.: US 11,346,195 B2
(45) Date of Patent: May 31, 2022

(54) CONCURRENT FLUID INJECTION AND HYDROCARBON PRODUCTION FROM A HYDRAULICALLY FRACTURED HORIZONTAL WELL

(71) Applicant: Saudi Arabian Oil Company, Dhahran (SA)

(72) Inventors: Huseyin Onur Balan, Katy, TX (US); Anuj Gupta, Houston, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/021,843

(22) Filed: Sep. 15, 2020

(65) Prior Publication Data

US 2022/0082001 A1 Mar. 17, 2022

(51) Int. Cl.
*E21B 43/16* (2006.01)
*E21B 7/04* (2006.01)
(Continued)

(52) U.S. Cl.
CPC ..... *E21B 43/16* (2013.01); *E21B 7/046* (2013.01); *E21B 33/12* (2013.01); *E21B 43/12* (2013.01); *E21B 43/164* (2013.01)

(58) Field of Classification Search
CPC ..... E21B 43/26
See application file for complete search history.

(56) References Cited

U.S. PATENT DOCUMENTS 4,512,400 A 4/1985 Simon
4,620,592 A 11/1986 Perkins
(Continued)

FOREIGN PATENT DOCUMENTS

CN 106761611 A 5/2017
CN 110242264 A 9/2019
(Continued)

OTHER PUBLICATIONS

Mechanical English translation of Patent No. CN110242264 A, published Sep. 17, 2019, 14 pages.
(Continued)

*Primary Examiner* — William D Hutton, Jr.
*Assistant Examiner* — Avi T Skaist
(74) *Attorney, Agent, or Firm* — Bracewell LLP; Constance G. Rhebergen; Eleanor L. Tyson

(57) ABSTRACT

A method for concurrent fluid injection and production of a reservoir fluid from a hydraulically fractured horizontal well comprising the steps of completing a well in a formation to create the hydraulically fractured horizontal well; designating an alpha group; designating a beta group, such that each segment is in either the alpha group or the beta group, wherein the number and location of the segments in each of the alpha group and the beta group are based on the production configuration; initiating a first mode of operation; operating the hydraulically fractured horizontal well in the first mode of operation for a first mode run time; stopping the first mode of operation; initiating the second mode of operation; operating the hydraulically fractured horizontal well in the second mode of operation for a second mode run time; and cycling between the first mode of operation and the second mode of operation.

18 Claims, 8 Drawing Sheets

(51) Int. Cl.
*E21B 33/12* (2006.01)
*E21B 43/12* (2006.01)

(56) References Cited

U.S. PATENT DOCUMENTS

| | | | | |
|---|---|---|---|---|
| 9,631,466 | B2 | 4/2017 | Greci et al. | |
| 10,208,547 | B2 | 2/2019 | Kjøholt et al. | |
| 10,400,562 | B2 * | 9/2019 | Ayasse | E21B 43/40 |
| 2009/0229826 | A1 | 9/2009 | East et al. | |
| 2013/0228337 | A1 | 9/2013 | Dombrowski et al. | |
| 2015/0096756 | A1 * | 4/2015 | Sharma | E21B 43/26 166/306 |
| 2015/0369023 | A1 | 12/2015 | Macphail et al. | |
| 2016/0003017 | A1 | 1/2016 | Keller et al. | |
| 2016/0177686 | A1 | 6/2016 | Carvajal et al. | |
| 2017/0030173 | A1 | 2/2017 | Macphail et al. | |
| 2017/0284179 | A1 | 10/2017 | Butula et al. | |
| 2019/0003295 | A1 | 1/2019 | Ehlig-Economides et al. | |

FOREIGN PATENT DOCUMENTS

| | | | |
|---|---|---|---|
| WO | 2014124533 | A1 | 8/2014 |
| WO | 2017028322 | A1 | 2/2017 |
| WO | 2020185236 | A1 | 9/2020 |

OTHER PUBLICATIONS

PCT International Patent Search dated Nov. 22, 2021, in the prosecution of PCT/US2021/050018, 17 pages.

* cited by examiner

CONCURRENT FLUID INJECTION AND HYDROCARBON PRODUCTION FROM A HYDRAULICALLY FRACTURED HORIZONTAL WELL

TECHNICAL FIELD

Disclosed are systems and methods for oilfield production. Specifically, disclosed are systems and methods for injection points and production points from a hydrocarbon well.

BACKGROUND

Horizontal well drilling and multi-stage hydraulic fracturing technologies made possible economic recovery of hydrocarbons from extremely low permeability source rock and tight reservoirs, such as shale oil reservoirs. However, the recovery factor, the recoverable amount of hydrocarbon initially in place in the reservoir, expressed as a percentage, have remained at levels of less than 10% oil or 15% volatile oil for Eagle Ford field with primary depletion. One reason that led to the low recovery factor conditions is aggressive well depletion strategies (for example, where bottomhole pressures are kept below saturation pressures) resulting in two-phase flow in the reservoir and hydraulic fractures, and partial closure of hydraulic fractures with depletion. A second reason is the extremely low permeability and high capillary pressure characteristics of unconventional reservoir rocks. A third reason is fracking of a child well adjacent to a depleted parent well, which leads to fracture hits and sub-performance of parent and child wells.

While different enhanced recovery methods to improve displacement efficiency for low permeability reservoirs have been proposed and discussed in the literature, techniques to increase volumetric sweep efficiency have not been. Conventional cycling injection techniques include huff-n-puff and soaking. A single cycle of huff-n-puff process refers to a gas phase injection followed by hydrocarbon production. A single cycle of soaking process refers to liquid-phase injection followed by soaking period, and then hydrocarbon production.

Conventional cycling injection techniques have several drawbacks. For example, the production period is interrupted during injection cycles, which can be detrimental for project economics. The intermittent nature of huff-n-puff methods may lead to large fluctuations in production rates leading to inefficient utilization of pipeline capacity, and also large fluctuations in demand for injection fluid limiting the scope of the project. In addition, reservoir volume contacted by injection fluid is limited in such processes, which leads to low recovery factor.

SUMMARY

Disclosed are systems and methods for oilfield production. Specifically, disclosed are systems and methods for injection points and production points from a hydrocarbon well.

In a first aspect, a method for concurrent fluid injection and production of an reservoir fluid is provided. The method includes the step of completing a well in a formation to create a hydraulically fractured horizontal well, where the well extends from a surface through the formation. The hydraulically fractured horizontal well includes a wellbore extending into the formation, the wellbore having a trajectory through the formation, hydraulic fractures extending from the wellbore into the formation in fluid communication with the formation and with the wellbore, a casing defining an interior of the wellbore, the casing includes casing perforations such that the casing perforations extend through the casing in fluid communication between the hydraulic fractures and the interior of the wellbore, where the hydraulic fractures fluidly connect the interior of the wellbore and the formation, packers separating the wellbore into two or more segments such that the packers prevent fluid communication between each segment, where each segment includes one or more hydraulic fractures, an injection tubing extending from the surface through the interior of the casing, through the packers, and through the segments, where the injection tubing includes injection perforations in each segment, where an injection flow control instrument is configured to adjust flow through the injection perforations, and a production tubing extending from a surface through the interior of the casing, through the packers, and through the segments, where the production tubing includes production perforations in each segment, where a production flow control instrument is configured to adjust flow through the production perforations. The method further includes the steps of designating an alpha group, where the alpha group includes one or more segments, designating a beta group, where the beta group includes one or more segments such that each segment is in either the alpha group or the beta group, where the number and location of the segments in each of the alpha group and the beta group are based on the production configuration, and initiating a first mode of operation. Initiating the first mode of operation includes the steps of opening the injection flow control instruments on the injection tubing in the alpha group, where the alpha group includes injection segments during the first mode of operation, and opening the production flow control instruments on the production tubing in the beta group, where the beta group includes production segments during the first mode of operation. The method for concurrent fluid injection and production of a reservoir fluid further includes the steps of operating the hydraulically fractured horizontal well in the first mode of operation for a first mode run time. The step of operating the hydraulically fractured horizontal well in the first mode of operation includes the steps of injecting an injection fluid through the injection tubing in the alpha group, maintaining the injection of the injection fluid such that the injection fluid flows from the injection tubing through the injection flow control instruments to the interior of the casing, maintaining the injection of the injection fluid such that the injection fluid flows from the interior of the casing through the hydraulic fractures into the formation, driving the reservoir fluid from the formation to hydraulic fractures in the beta group due to the flow of the injection fluid, receiving the reservoir fluid through the hydraulic fractures into the interior of the casing, removing the reservoir fluid through the production flow control instruments to the production tubing, and removing the reservoir fluid through the production tubing of the beta group to the surface. The method for concurrent fluid injection and production of a reservoir fluid further includes the steps of stopping the first mode of operation. Stopping the first mode of operation includes the steps of closing the injection flow control instruments in the alpha group at the completion of the run time, and closing the production flow control instruments in the beta group at the completion of the run time. The method for concurrent fluid injection and production of a reservoir fluid further includes the step of initiating the second mode of operation. Initiating the second mode of operation includes the steps of opening the production flow control instruments in the alpha group, where the alpha group includes production segments during a second mode of operation, and opening the injection flow control instruments in the beta group, where the beta group includes injection segments during the second mode of operation. The method for concurrent fluid injection and production of a reservoir fluid further includes the step of operating the hydraulically fractured horizontal well in the second mode of operation for a second mode run time. Operating the second mode of operation includes the steps of injecting an injection fluid through the injection tubings in the beta group, maintaining the injection of the injection fluid such that the injection fluid flows from the injection tubing through the injection flow control instruments to the interior of the casing, maintaining the injection of the injection fluid such that the injection fluid flows from the interior of the casing through the hydraulic fractures into the formation, driving the reservoir fluid from the formation to hydraulic fractures in the production segments of the alpha group due to the flow of the injection fluid, receiving the reservoir fluid through the hydraulic fractures into the interior of the casing, removing the reservoir fluid through the production flow control instruments to the production tubing, and removing the reservoir fluid through the production tubings of the alpha group to the surface. The method of concurrent fluid injection and production of a reservoir fluid further includes the step of cycling between the first mode of operation and the second mode of operation for a production time.

In certain aspects, the injection flow control instrument is selected from the group consisting of inflow control devices, inflow control valves, and combinations of the same, and where the production flow control instrument is selected from the group consisting of inflow control devices, inflow control valves, and combinations of the same. In certain aspects, the injection fluid is selected from the group consisting of water, brine, carbon dioxide, reservoir gases, reservoir fluids, flue gas, air, and combinations of the same. In certain aspects, the reservoir fluid is selected from the group consisting of liquid hydrocarbons, natural gas, water, brine, and combinations of the same. In certain aspects, the injection fluid includes an additive, the additive selected from the group consisting of surfactants, polymers, solvents, nano-particles, and combinations of the same. In certain aspects, one or more pressure gauges is installed along the production tubing configured to measure pressure in the production tubing, and one or more pressure gauges installed along the injection tubing configured to measure a pressure in the injection tubing. In certain aspects, the packers are selected from the group consisting of production packers, inflatable packers, and combinations of the same. In certain aspects, the method further includes the steps of collecting in real time distributed wellbore data from one or more instrument installed in the hydraulically fractured horizontal well during the first mode of operation, wherein the one or more instruments are selected from the group consisting of temperature gauges, pressure gauges, acoustic measuring devices, and combinations of the same, adding the distributed wellbore data to a reservoir simulation model during the first mode of operation, running the reservoir simulation model to create a simulated result, and adjusting the first mode run time based on the simulated result. In certain aspects, the method further includes the steps of collecting in real time distributed wellbore data from one or more instrument installed in the hydraulically fractured horizontal well during the second mode of operation, wherein the one or more instruments are selected from the group consisting of temperature gauges, pressure gauges, acoustic measuring devices, and combinations of the same, adding the distributed wellbore data to a reservoir simulation model during the second mode of operation, running the reservoir simulation model to create a simulated result, and adjusting the second mode run time based on the simulated result.

In a second aspect, a method for concurrent fluid injection and production of a reservoir fluid of a reservoir fluid is provided. The method includes the steps of completing a well in a formation to create a hydraulically fractured horizontal well, where the well extends from a surface through the formation. The hydraulically fractured horizontal well includes a wellbore extending into the formation, the wellbore having a trajectory through the formation, hydraulic fractures extending from the wellbore into the formation in fluid communication with the formation and with the wellbore, a casing defining an interior of the wellbore, the casing includes casing perforations such that the casing perforations extend through the casing in fluid communication between the hydraulic fractures and the interior of the wellbore, where the hydraulic fractures in fluidly connecting the interior of the wellbore and the formation, a packer separates the wellbore into an alpha group and a beta group, where the packer is configured to prevent fluid communication between each group, where the beta group is farther along the trajectory from the surface than the alpha group, where each group includes a segment, where each segment includes one or more hydraulic fractures, a fluid tubing extending from the surface through the interior of the casing, through the alpha group, through the packer into the beta group and through the beta group along the trajectory, where the fluid tubing includes fluid perforations in the beta group, and an annulus defined by the space between the casing and the fluid tubing in the alpha group. The method of concurrent fluid injection and production of a reservoir fluid further includes the step of operating the hydraulically fractured horizontal well in a first mode of operation for a first mode run time. The step of operating the hydraulically fractured horizontal well in a first mode of operation includes the steps of injecting an injection fluid through the fluid tubing, maintaining the injection of the injection fluid such that the injection fluid flows from the fluid tubing through the fluid perforations in the beta group, maintaining the injection of the injection fluid such that the injection fluid flows through the hydraulic fractures in the beta group into the formation, driving the reservoir fluid from the formation to hydraulic fractures in the alpha group due to the flow of the injection fluid, receiving the reservoir fluid through the hydraulic fractures into the annulus of the alpha group, and removing the reservoir fluid through the annulus to the surface. The method of concurrent fluid injection and production of a reservoir fluid further includes the steps of stopping the first mode of operation, initiating the second mode of operation, and operating the hydraulically fractured horizontal well in the second mode of operation for a second mode run time. The step of operating the hydraulically fractured horizontal well in a second mode of operation includes the steps of injecting an injection fluid through the annulus of the alpha group, maintaining the injection of the injection fluid such that the injection fluid flows from the annulus through the hydraulic fractures in the alpha group and into the formation, driving the reservoir fluid from the formation to hydraulic fractures in the beta group due to the flow of the injection fluid, receiving the reservoir fluid through the hydraulic fractures into the interior of the casing, and removing the reservoir fluid through the fluid perforations in in the fluid tubing in the beta group and to the surface. The method of concurrent fluid injection and production of a reservoir fluid further includes the step of cycling between the first mode of operation and the second mode of operation for a production time.

In certain aspects, the fluid tubing includes a pressure gauge configured to measure a pressure in the fluid tubing. In certain aspects, the annulus includes a pressure gauge configured to measure a pressure in the annulus.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

Figure 1:
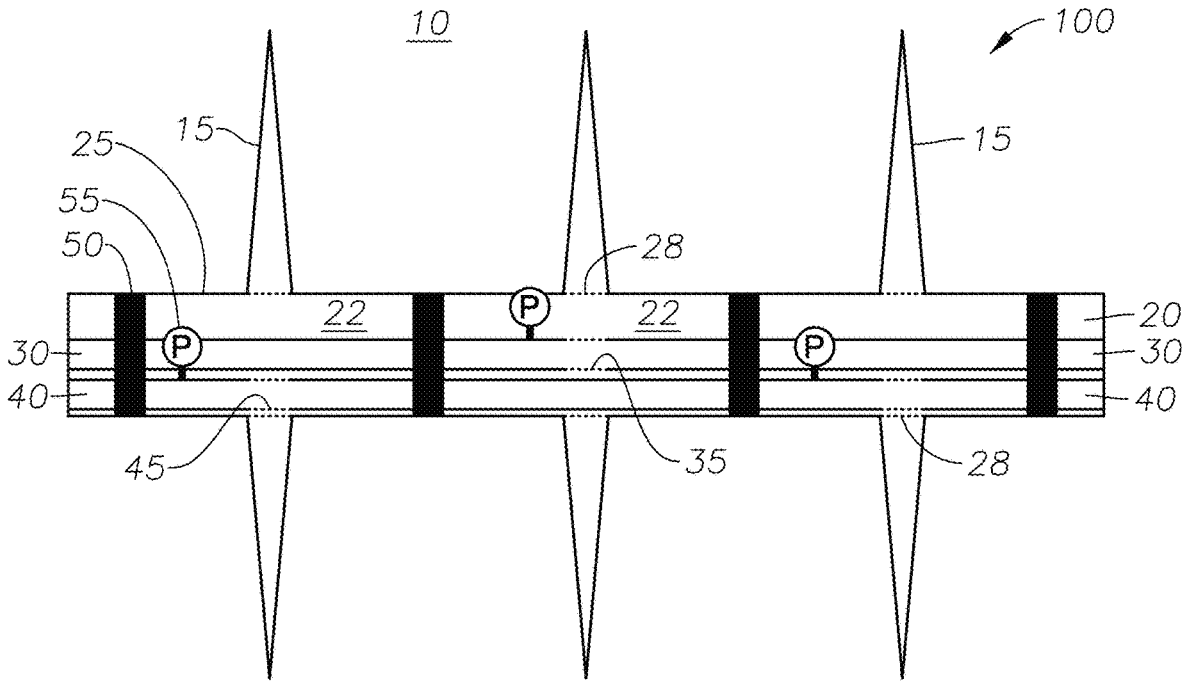
FIG. 1 provides an embodiment of a hydraulically fractured horizontal well.

In the accompanying Figures, similar components or features, or both, may have a similar reference label.

DETAILED DESCRIPTION

While the scope of the apparatus and method will be described with several embodiments, it is understood that one of ordinary skill in the relevant art will appreciate that many examples, variations and alterations to the apparatus and methods described here are within the scope and spirit of the embodiments.

Accordingly, the embodiments described are set forth without any loss of generality, and without imposing limitations, on the embodiments. Those of skill in the art understand that the scope includes all possible combinations and uses of particular features described in the specification.

Hydrocarbon recovery efficiency is equal to the product of displacement efficiency and volumetric sweep efficiency. Displacement efficiency is the amount of hydrocarbon displaced per the amount of hydrocarbon contacted by a displacing agent. Volumetric sweep efficiency is the volume of hydrocarbon contacted by a displacing agent per volume of hydrocarbon in place. Advantageously, the methods and systems described can improve the volumetric sweep efficiency compared to conventional huff-n-puff operations, because the methods and systems result in continuously sweeping hydrocarbons-in-place from the injection segments to the production segments. Advantageously, the systems and methods described here can ensure steady or non-fluctuating injection rates and production rates, which can improve production yield.

Advantageously, concurrent fluid injection and production of reservoir fluids from a hydraulically fractured well can prevent extreme depletion of reservoir pressure in the stimulated reservoir volume (SRV). Preventing extreme depletion of reservoir pressure is advantageous for several reasons. First, maintaining reservoir pressure in the SRV can help to keep hydraulic fractures open, resulting in depletion of a larger SRV, and, therefore, increased recovery. Second, preventing extreme depletion of reservoir pressure can improve recovery by reducing or eliminating a two-phase flow in the SRV and hydraulic fractures by keeping reservoir pressure greater than saturation pressure. The saturation pressure is the bubble point pressure a liquid and the dew point pressure for a condensate or gas. Finally, pressure maintenance in the SRV can mitigate frac hits resulting from fracturing child wells. Frac hits can be observed on partially depleted hydraulically fractured horizontal wells when a child well is drilled next to the parent well and is also fracked. Parent wells under primary depletion decrease the pressure and change the stress field in its SRV. Hydraulic fractures initiated from the child well preferentially propagate towards the depletion zone of the parent well. Frac hits connect the fracture network of parent and child wells, and result in reduced productivity from the parent well. In addition, the child well does not perform as well as the original parent well, since both wells compete for overlapping resource zones. In addition, frac hits result in creation of less complex fractures around child wells, which is another reason why child well do not perform as well as parent wells. The concurrent fluid injection and production of a reservoir fluid methods and systems proposed here eliminates the need to refrac the parent well before fracking the child well by preventing extreme depletion of reservoir pressure.

Advantageously, the systems and methods provided here allow for continuous hydrocarbon production without interruption while injecting injection fluids. Advantageously, concurrent fluid injection and production of a reservoir fluid with carbon dioxide as the injection fluid can be used for carbon dioxide sequestration.

As used throughout, "formation conditions" refers to the fracture surface area, fracture conductivity, reservoir rock and fluid properties, and combinations of the same. The reservoir rock and fluid properties include permeability, porosity, pressure, temperature, fluid density, fluid viscosity, fluid compressibility, and combinations of the same.

As used throughout, "group" refers to an injection group, a production group, or both depending on the context.

As used throughout, "reservoir fluid" refers to fluids in a formation that can be produced due to drilling and recovery operations. Examples of reservoir fluids include liquid hydrocarbons, natural gas, water, brine, and combinations of the same.

As used throughout, "injection fluid" refers to any fluid that can be injected into a formation and function to drive a fluid from the formation. Injection fluids can include any enhanced oil recovery fluid. Examples of injection fluids include water, brine, carbon dioxide, reservoir gases, reservoir fluids, flue gas, air, and combinations of the same. The injection fluid can include an additive. The additive can be any type of additive suitable for use in an injection fluid. Examples of additives include surfactants, polymers, solvents, nano-particles, and combinations of the same. The injection fluid can be at a temperature designed to increase drive of the reservoir fluid in the formation. The injection fluid can be selected to react with solid surfaces in the formation, such as the reservoir rock, to improve permeability. The injection fluid can be selected to react with kerogen to upgrade hydrocarbons in place. Air or oxygen can be selected as the injection fluid to react with kerogen. When the reaction of the injection fluid is an exothermic reaction the increased temperature can improve recovery by decreasing reservoir fluid viscosity.

As used throughout, "injection group" refers to one or more injection segments. The optimum number of injection segments in each injection group can be determined by the wellbore trajectory, physical data of the well, and reservoir simulation models.

As used throughout, "injection segment" refers to a segment designated for injection of an injection fluid from the surface into the formation. Each injection segment can be isolated from production segments by packers.

As used throughout, "production group" refers to one or more production segments. The optimum number of production segments in each production group can be determined by the wellbore trajectory, physical data of the well, and reservoir simulation models.

As used throughout, "production mode" refers to the mode of operation as part of the production strategy for concurrent fluid injection and production of a reservoir fluid and encompasses which segments and group are operating simultaneously.

As used throughout, "production segment" refers to a segment designated for production of a reservoir fluid from the formation to the surface. Each production segment can be isolated from injection segments by packers.

As used throughout, "real-time" or "in real-time" refers to an active or in operation system, function, or process. For example, real-time measurements refers to measurements of a system or process taken while the system or process is in operation. For example, real-time data refers to data collected or observed while the system or process is in operation. A reference to "in real-time" refers to a live process as opposed to one that is recorded.

As used throughout, "segment" refers to one or more neighboring hydraulic fractures. The number of hydraulic fractures in each segment depends on the wellbore, the design of the hydraulically fractured horizontal well, the formation conditions, and the results of reservoir simulation models. Each segment can be separated by a packer. The term segment includes both injection segments and production segments unless otherwise specified.

As used throughout, "stimulated reservoir volume" or "SRV" refers to the volume of a reservoir whose permeability is enhanced through creating a network of hydraulic fractures, activated natural fractures by implementing a well stimulation treatment.

As used throughout, "substantially" refers to greater than 90%.

As used throughout, "trajectory" refers to the physical path of a wellbore through a formation. The trajectory includes the depth, the length, the orientation relative to a surface, the diameter and can be determined based on well surveys and logs collected during and after drilling.

Concurrent fluid injection and production of a reservoir fluid can occur in hydraulically fractured horizontal well 100 described with reference to FIG. 1. Hydraulically fractured horizontal well 100 can have a trajectory through formation 10. Formation 10 can be any type of material containing a reservoir fluid and that can be hydraulically fractured. Examples of formation 10 include source rock, tight rock reservoirs, and any low permeability reservoir rock. Wellbore 20 can be finished with casing 25 such that the interior of casing 25 defines the size and shape of wellbore 20. Wellbore 20 can be produced by any method of producing a wellbore with a trajectory through a formation. Casing 25 can include any materials suitable for use in finishing a wellbore. Casing 25 can include a cement layer, a piping layer, and combinations of the same.

Hydraulic fractures 15 can extend from wellbore 20 into formation 10. Hydraulic fractures 15 enable fluid communication between formation 10 and wellbore 20. Hydraulic fractures 15 can be produced by any process capable of fracturing a formation. Hydraulic fractures 15 depicted in FIG. 1 are for illustrative purposes only, each segment can have more than two hydraulic fractures per segment. One of skill in the art will understand that as shown in the figures, the hydraulic fractures are for illustrative purposes only and not meant to disclose the exact number of hydraulic fractures per segment.

Casing 25 contains casing perforations 28. Casing perforations 28 can align with hydraulic fractures 15. Casing 25 can contain perforations or the perforations can be created as part of the process to create hydraulic fractures 15. The size, number and shape of casing perforations 28 can be due to the method of creating casing perforations 28. The spacing between clusters of casing perforations can depend on the completion design.

Injection tubing 30 with injection perforations 35 extends through wellbore 20. Injection tubing 30 can be any type of tubing capable of transmitting a fluid from a surface through a wellbore. The length, diameter, and material of construction of injection tubing 30 can depend on the trajectory of wellbore 20, the type of formation 10, the temperature and pressure in wellbore 20, the injection rate and the selected injection fluid. The size, number and shape of injection perforations 35 can depend on the desired flow rate of the injection fluid and the method of creating the injection perforations 35. Injection perforations 35 can be grouped along the length of injection tubing 30 to align with hydraulic fractures 15 in each injection segment. The number of groupings and the position of each grouping can be based on the production strategy.

Production tubing 40 with production perforations 45 extends through wellbore 20. Production tubing 40 can be any type of tubing capable of transmitting a fluid from a wellbore to a surface. The length, diameter, and material of construction of production tubing 40 can depend on the trajectory of wellbore 20, the type of formation 10, the temperature and pressure in wellbore 20, the production rate, and the type of reservoir fluids. The size, number and shape of production perforations 45 can depend on the desired flow rate of the reservoir fluid and the method of producing the production perforations 45. Production perforations 45 can be grouped along the length of production tubing 40 to align with hydraulic fractures 15 in each product segment. The number of groupings and the position of each grouping can be based on the production strategy.

Wellbore 20 can be separated into two or more segments 22 using packers 50. Each segment 22 can include one or more hydraulic fractures 15. Packer 50 can be any type of device capable of isolating a segment of a wellbore from another segment of the wellbore while allowing tubings through both segments. Packer 50 can be placed inside of casing 25. Packers suitable for use as packer 50 can include production packers, inflatable packers, and combinations of the same. Packer 50 can be permanent or removable. Packer 50 can be connected to the surface through wireline, pipe, or coiled tubing.

Packers 50 are positioned such that each segment 22 contains only injection perforations 35 or production perforations 45. Both injection tubing 30 and production tubing 40 can extend through a segment, but only one of the tubings is perforated in each segment. Packers 50 are positioned such that one segment is fluidly isolated from every other segment.

Each segment 22 can include one or more instruments capable of measuring a property in the segment. Instruments can include temperature gauges, pressure gauges, acoustic measuring devices, and combinations of the same. In at least one embodiment, a temperature gauge is a distributed temperature sensing (DTS) device. In at least one embodiment, an acoustic measuring device is a distributed acoustic sensing (DAS) device. The instruments can be in electronic communication with the surface through fiber optic cables. The instruments can send real-time measurements to the surface through the fiber optic cables. The fiber optic cables connecting each instrument to the surface can extend through each packer 50 between the instrument and the surface. The deployment of instruments can be determined based on the need to collect distributed wellbore monitoring data, which includes data related to temperature, pressure, rates, acoustic data and combinations of the same. In at least one embodiment, the distributed wellbore monitoring data can include real-time data collected from flow control instruments and pressure gauges installed in the hydraulically fractured horizontal well. The distributed wellbore monitoring data can be used in the reservoir simulation model to analyze and predict the formation conditions of formation 10. Additionally, the distributed wellbore monitoring data can be used to update historical reservoir simulation models to improve their predictions for recovery.

A model can be prepared and updated with data from each step of production. The initial model includes petrophysical data and geological data of formation 10. The initial model can be used to develop the trajectory of wellbore 20 through formation 10. After the wellbore 20 is completed, the actual trajectory of wellbore 20 can be input to the initial model to produce a trajectory model. The trajectory model can be used to simulate different operating scenarios within wellbore 20, including the number of segments per well, the location of each segment along the trajectory of wellbore 20, the number of fractures per segment, the fracture spacing and half-lengths in each segment, injection rates per segment, and production rates per segment. The trajectory model can be used to simulate the optimal configuration of the hydraulically fractured horizontal well. After the hydraulically fractured horizontal well has been completed, the trajectory model can be updated with the physical data of hydraulically fractured horizontal well to create the reservoir simulation model. The physical data of the hydraulically fractured horizontal well includes the number of segments, the number of hydraulic fractures per segment, the fracture spacing and half-lengths in each segment. The reservoir simulation model can be used to run simulations to optimize the production strategy for concurrent fluid injection and production of a reservoir fluid, including the injection rate per segment, the production rate per segment, the selected injection fluid, the production mode, the designation of the alpha group and beta group, the run time. The reservoir simulation model can be updated with data on the formation conditions. The reservoir simulation model can be updated with the distributed wellbore monitoring data. The reservoir simulation model can be updated in real-time or for historical analysis. In addition to the distributed wellbore monitoring data, the reservoir simulation model can be updated with production log data, data about production log data developed from AI/machine learning algorithms, and physics-based simulation models.

In each segment 22, the perforated tubing can include pressure gauge 55. Pressure gauge 55 can provide real-time measurement of the pressure in the perforated tubing. The real-time data provided by each pressure gauge 55 can be used to monitor displacement in formation 10. Monitoring displacement in formation 10 can provide an estimate of the formation conditions which can provide a method of monitoring the overall production efficiency from and depletion of formation 10. The real-time measurements from pressure gauges 55 can be combined with the injection rate and the production rate in simulation models to provide an estimate of the formation conditions.

In an alternate embodiment described with reference to FIG. 2, and with reference to FIG. 1, flow control instrument 60 can be installed over the perforations on each tubing. Flow control instrument 60 can be any type of flow device capable of adjusting a flow rate of a fluid in real-time. Examples of flow devices suitable for use as flow control instrument 60 include inflow control devices, inflow control valves, and combinations of the same. The distribution of flow control instrument 60 can be based on the trajectory of wellbore 20. In at least one embodiment, each segment can contain a flow control instrument 60. In an alternate embodiment, less than all segments can contain a flow control instrument 60 such that the flow is controlled in only some of the segments. Flow control instrument 60 can be controlled manually or automatically. In embodiments where flow control instrument 60 is controlled manually, an operator adjusts the flow rate based on the real-time data. In embodiments where flow control instrument 60 is controlled automatically based on programming codes or artificial intelligence codes. Controlling the flow rate through injection tubing 30 and production tubing 40 can optimize the sweep efficiency. In certain embodiments, higher injection rates can reduce sweep efficiency, while still improving project economics. Advantageously, the use of the flow control instrument can control and mitigate liquid loading issues in the production tubing.

The strategy for concurrent fluid injection and production of a reservoir fluid is a function of the production configuration and the production mode. The production configuration refers to the number of segments in each of the injection group and the production group, the number of fractures in each segment, and the arrangement of the segments. The number of segments in each group, the number of groups, and the arrangement of the groups can be based on the formation conditions, including the trajectory of wellbore 20. The length of each segment, the location on the trajectory of wellbore 20, and the sequencing between injection segments and production segments depend on the wellbore, the design of hydraulically fractured horizontal well, and the formation conditions. Along the length of the wellbore each group can have a different number of segments and the injection groups can have different numbers of injection segments compared to the number of production segments in each production group.

Figure 3:
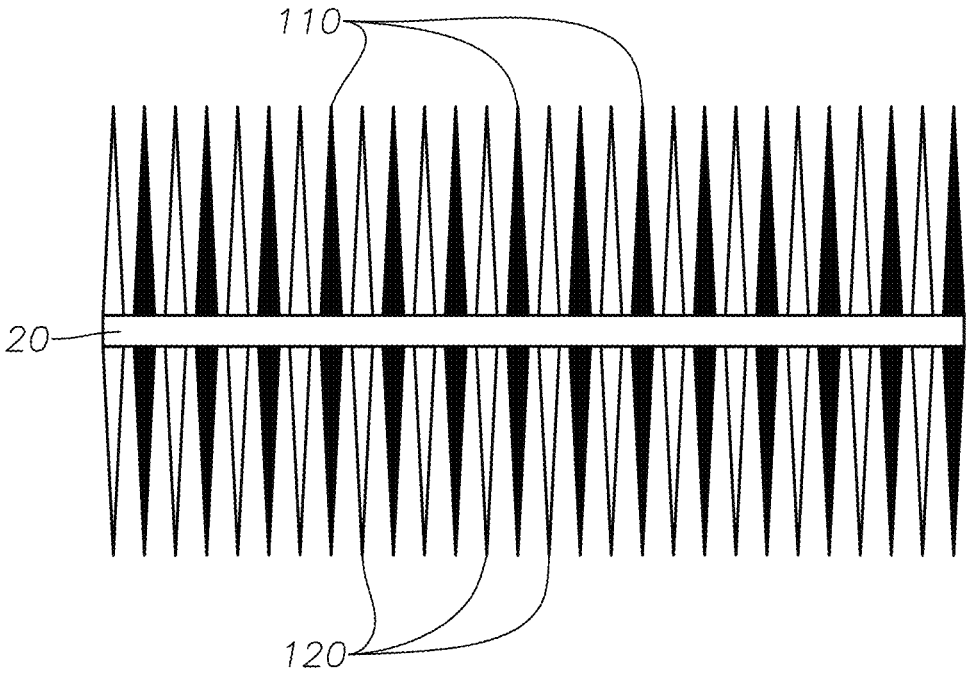
FIG. 3 provides an embodiment of a production configuration.
Figure 4:
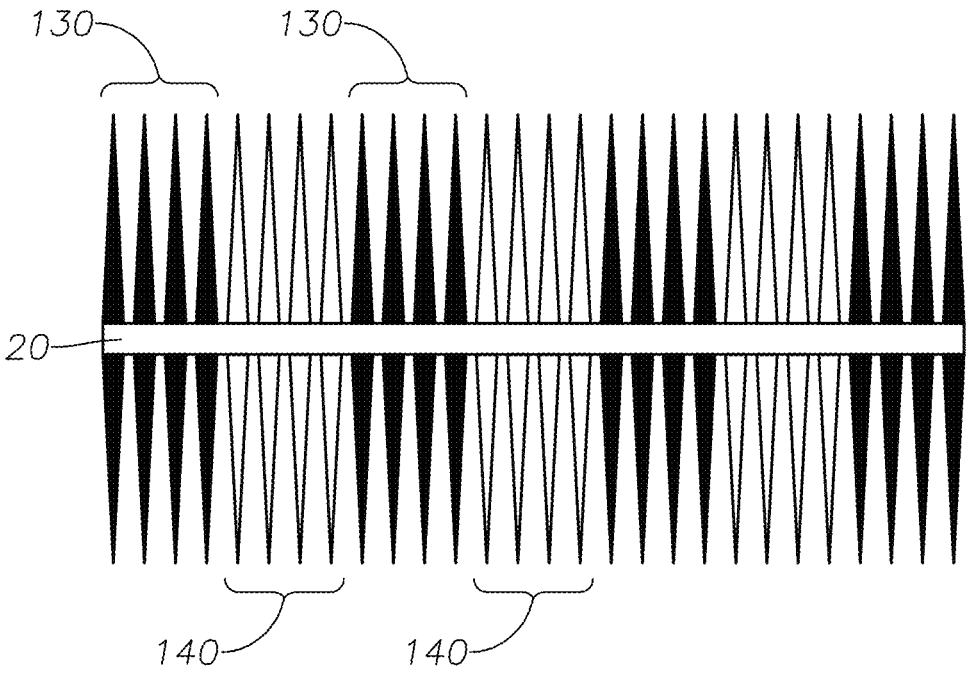
FIG. 4 provides an embodiment of a production configuration.
Figure 5A:
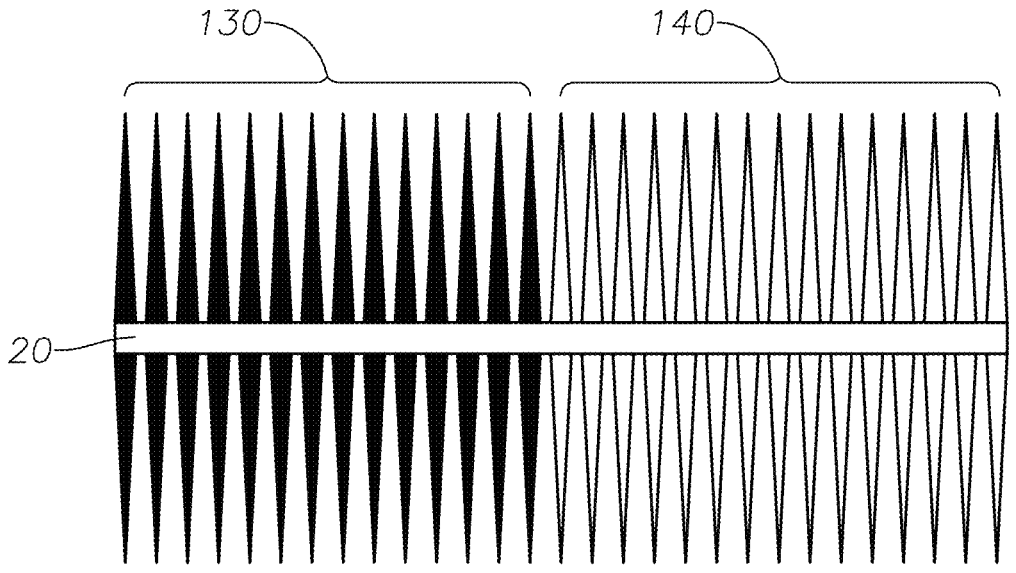
FIG. 5A provides an embodiment of a production configuration.
Figure 5B:
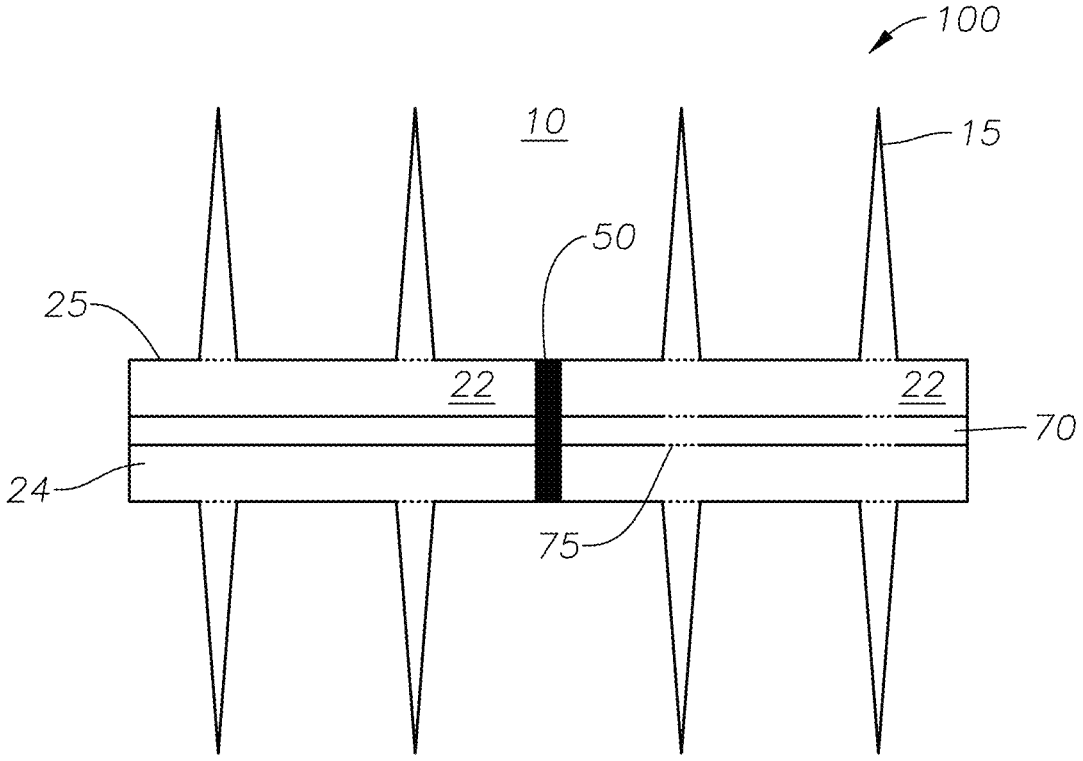
FIG. 5B provides an embodiment of a production mode.

The production configuration can be understood with reference to FIGS. 3-5. FIG. 3, with reference to FIG. 1, illustrates a production configuration where each injection segment contains one fracture and each production segment includes one fracture. Each production fracture 110 is bordered by injection fracture 120 and each injection fracture 120 is bordered by production fracture 110 resulting in an alternating pattern of fractures. In the production configuration with one fracture per segment, as illustrated in FIG. 3, there are no contiguous injection fractures and no contiguous production fractures. In the embodiment illustrated in FIG. 3, each injection group contains more than one injection segment and each production group contains more than one production segment. FIG. 4, with reference to FIG. 1, illustrates a production configuration where each injection segment includes four injection fractures and each production segment includes four production fractures. Each production segment 130 is bordered by injection segment 140 and each injection segment 140 is bordered by production segment 130 resulting in an alternating pattern of segments. In the production configuration with more than one fracture per segment, as illustrated in FIG. 4, there are contiguous injection fractures and contiguous production fracturess. In the embodiment illustrated in FIG. 4, each injection group contains more than one injection segment and each production group contains more than one production segment. Referring to FIGS. 5A and 5B, illustrates an embodiment where wellbore 20 is divided such that there is only one injection segment 140 and one production segment 130. In the embodiment illustrated in FIG. 5A, the injection group contains only one injection segment and the production group contains only one production segment. In the embodiment described with reference to FIG. 5B, hydraulically fractured horizontal well 100 contains two segments 22 isolated from each other by one packer 50. The number of hydraulic fractures 15 in each segment 22 can be based on the trajectory of wellbore 20, the completion design, and the desired production rate. Hydraulically fractured horizontal well 100 contains only one tubing, fluid tubing 70. Fluid tubing 70 can extend from the surface through wellbore 20 including through packer 50. Annulus 24 is created by the space in wellbore 20 between casing 25 and fluid tubing 70. Fluid tubing 70 is perforated in only one of the segments with fluid perforations 75. The length, diameter, and material of construction of fluid tubing 70 can depend on the trajectory of wellbore 20, the type of formation 10, the type of injection fluid, and the temperature and pressure in wellbore 20. The size, number and shape of fluid perforations 75 can depend on the desired flow rate of the fluid through fluid tubing 70 and the method of creating the fluid perforations 75. Fluid perforations 75 can be grouped along the length of fluid tubing 70 to align with hydraulic fractures 15. The number of groupings and the position of each grouping of fluid perforations 75 can be based on the production mode.

The production mode can include a single mode of operation and a cycling mode of operation. Hydraulically fractured horizontal well 100, as described with reference to FIGS. 1 and 2, can be completed based on the desired or targeted concurrent strategy for fluid injection and production of the reservoir fluid. The concurrent fluid injection and production of the reservoir fluid strategy for a formation is selected based on the formation conditions, the reservoir fluid, the injection fluid, the completion design, and the results of the reservoir simulation model.

In a single mode of operation, each segment is designated as either production or injection and that designation remains for the duration of production. The single mode of operation can be used with any of the production configurations described. In a single mode of operation, injection and production occur simultaneously.

Figure 2:
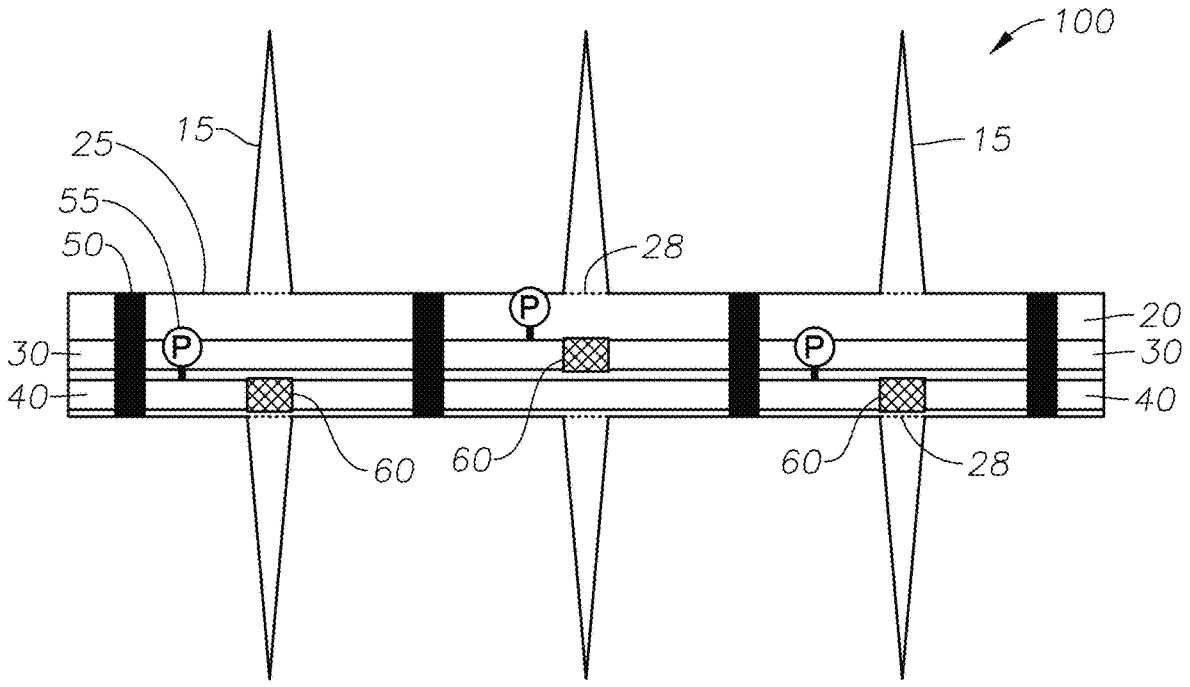
FIG. 2 provides an embodiment of a hydraulically fractured horizontal well.
Figure 6A:
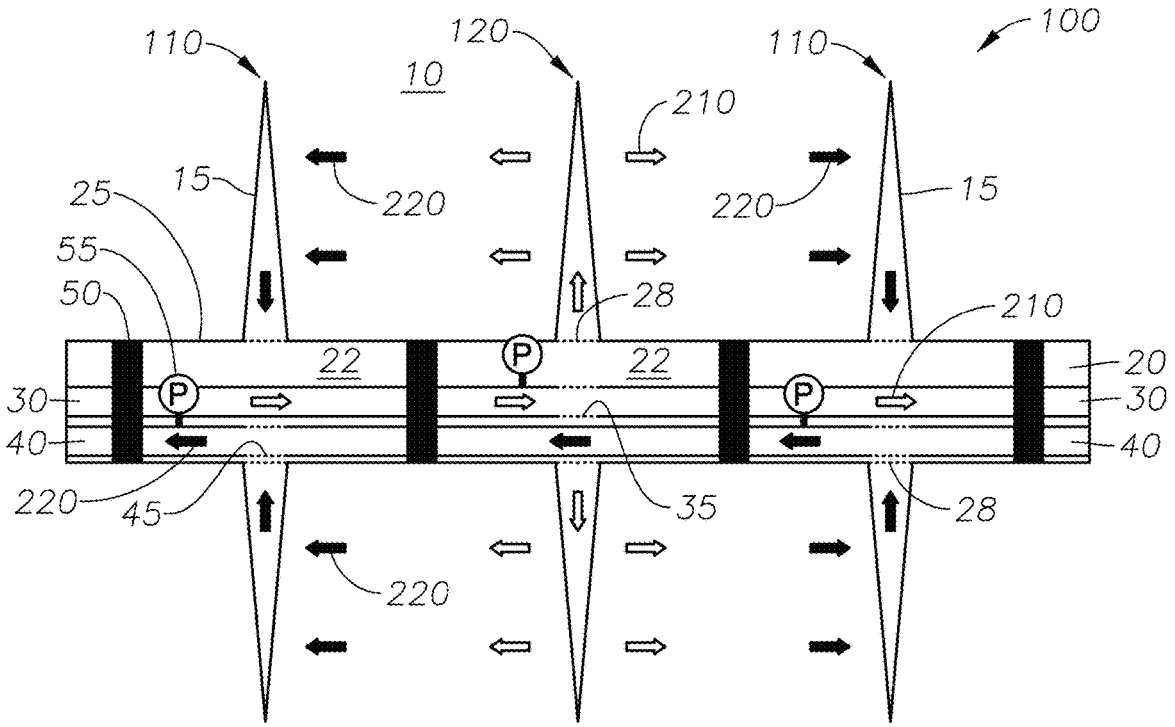
FIG. 6A provides an embodiment of a production mode.

Referring to FIG. 6A, with reference to FIG. 1, the single mode of operation is described where each injection fracture is bordered by a production fracture. In a first step of the method, injection fluid 210 is injected through injection tubing 30 to injection fracture 120. Injection fluid 210 flows through injection perforations 35 and through hydraulic fractures 15 of injection fractures 120. As injection fluid 210 flows from hydraulic fractures 15 in injection fracture 120 into formation 10, injection fluid 210 can drive reservoir fluid 220 in formation 10 toward hydraulic fractures 15 of production fractures 110. Reservoir fluid 220 can flow through hydraulic fractures 15 of production fractures 110. The reservoir fluid 220 can flow into production tubing 40 through production perforations 45 and through the production tubing 40 to the surface. Concurrent fluid injection and production of reservoir fluid in a single mode of operation can continue until formation 10 is depleted or substantially depleted of reservoir fluids.

Figure 6B:
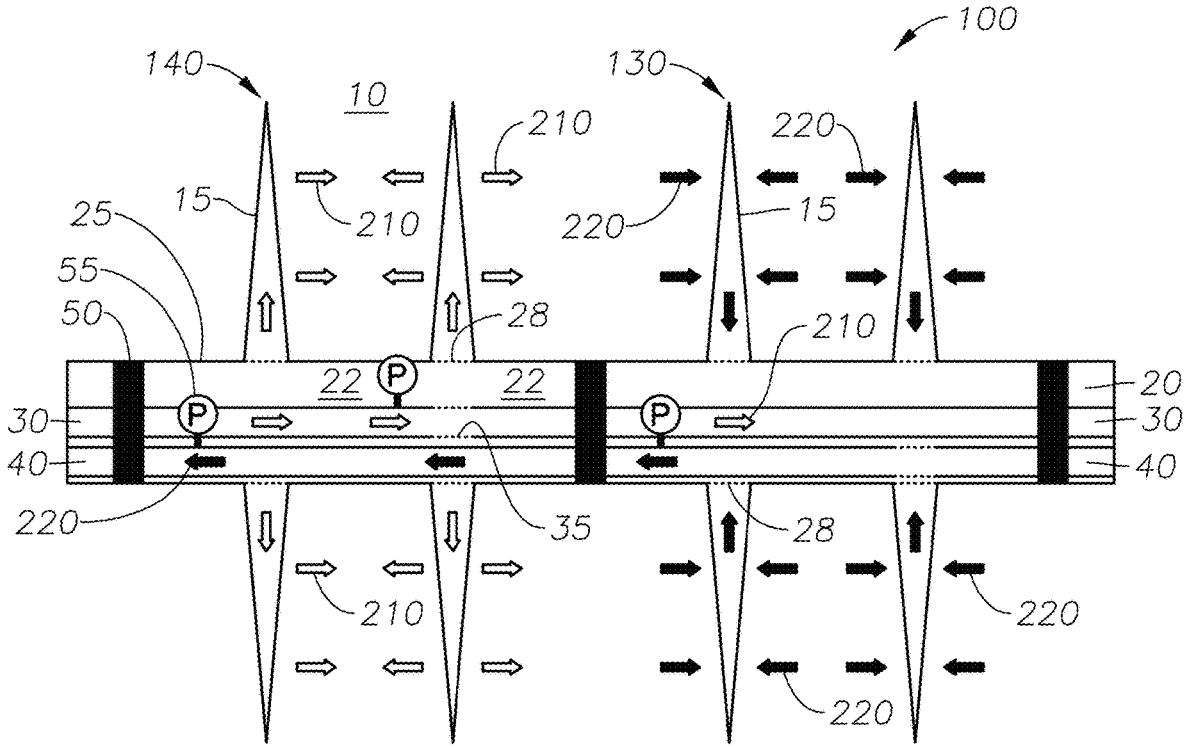
FIG. 6B provides an embodiment of a production mode

Referring to FIG. 6B, with reference to FIG. 1, the single mode of operation is described where injection segments include more than one injection fracture and are bordered by production segments with more than one production fracture. In a first step of the method, injection fluid 210 is injected through injection tubing 30 to injection segment 140. Injection fluid 210 flows through injection perforations 35 and through hydraulic fractures 15 of injection segment 140. As injection fluid 210 flows from hydraulic fractures 15 in injection segment 140 into formation 10, injection fluid 210 can drive reservoir fluid 220 in formation 10 toward hydraulic fractures 15 of production segment 130. Reservoir fluid 220 can flow through hydraulic fractures 15 of production segment 130. The reservoir fluid 220 can flow into production tubing 40 through production perforations 45 and through the production tubing 40 to the surface. Concurrent fluid injection and production of reservoir fluid in a single mode of operation can continue until formation 10 is depleted or substantially depleted of reservoir fluids.

Figure 7A:
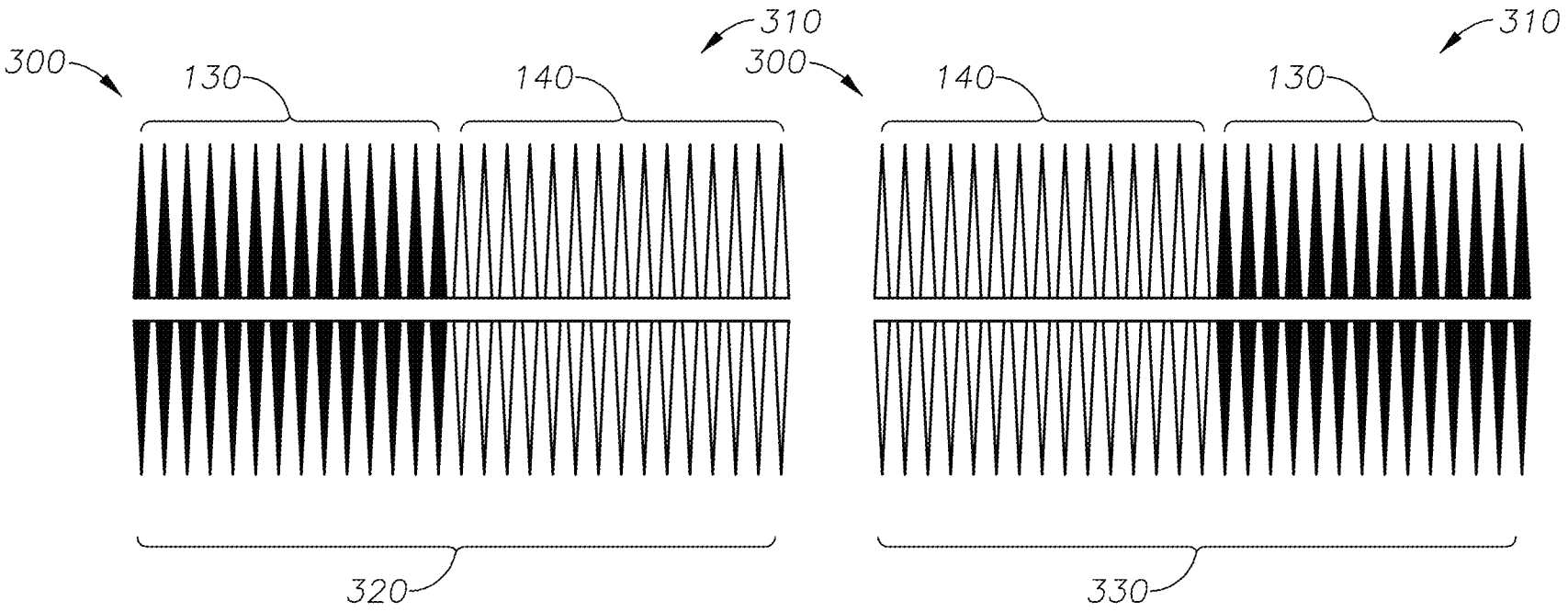
FIG. 7A provides an embodiment of a production mode.

Flow control instruments can be used in hydraulically fractured horizontal wells operated in a single mode of operation. In single mode of operation embodiments, the flow control instruments can be used to adjust the flow rates through the perforations to optimize injection rates and recovery rates. The flow control instruments remain at least partially open during the single mode of operation In a cycling mode of operation each group cycles between injection and production. Both injection and production occur simultaneously, but a group cycles between each. The cycling mode of operation can be used with any production configuration. In a hydraulically fractured horizontal well to be used for cycling mode of operation, each segment contains injection perforations with flow control instruments and production perforations with flow control instruments. The flow control instruments can adjust flow through each of the tubings depending on what the segment is designated. For example, when a segment is designated as part of the injection group, then the flow control instrument on the production tubing can shut and block flow of reservoir fluids while the flow control instrument can adjust to an opening to allow the flow of the injection fluid at the desired flow rate. When the mode of operation changes, the flow control instruments can adjust accordingly The cycling mode of operation can be understood with reference to FIGS. 7A and 7B. The groups in wellbore 20 can be designated as alpha group 300 and beta group 310. In first mode of operation 320, alpha group 300 can be designated as production groups 130 and beta group 310 can be designated as injection groups 140. First mode of operation 320 can continue for a first mode run time. After the first mode run time, first mode of operation 320 can be stopped and second mode of operation 330 can be initiated. In second mode of operation 330, alpha group 300 can be designated as injection groups 140 and beta group 310 can be designated as production groups 130. Second mode of operation 330 can continue for a second mode run time. After the second mode run time, operation cycles back to first mode of operation 320. Cycling between first mode of operation 320 and second mode of operation 330 can be for a production time. The production time can continue for the life of the concurrent fluid injection and production of a reservoir fluid. The length of each mode run time of each mode of operation can be based on distributed wellbore monitoring data. The duration of each mode run time can be determined by a simulation with the reservoir simulation model and can be optimized in real time with the reservoir simulation model to improve production yield across the life of the hydraulically fractured horizontal well. In each mode of operation alpha group 300 and beta group 310 operate simultaneously.

Figure 7B:
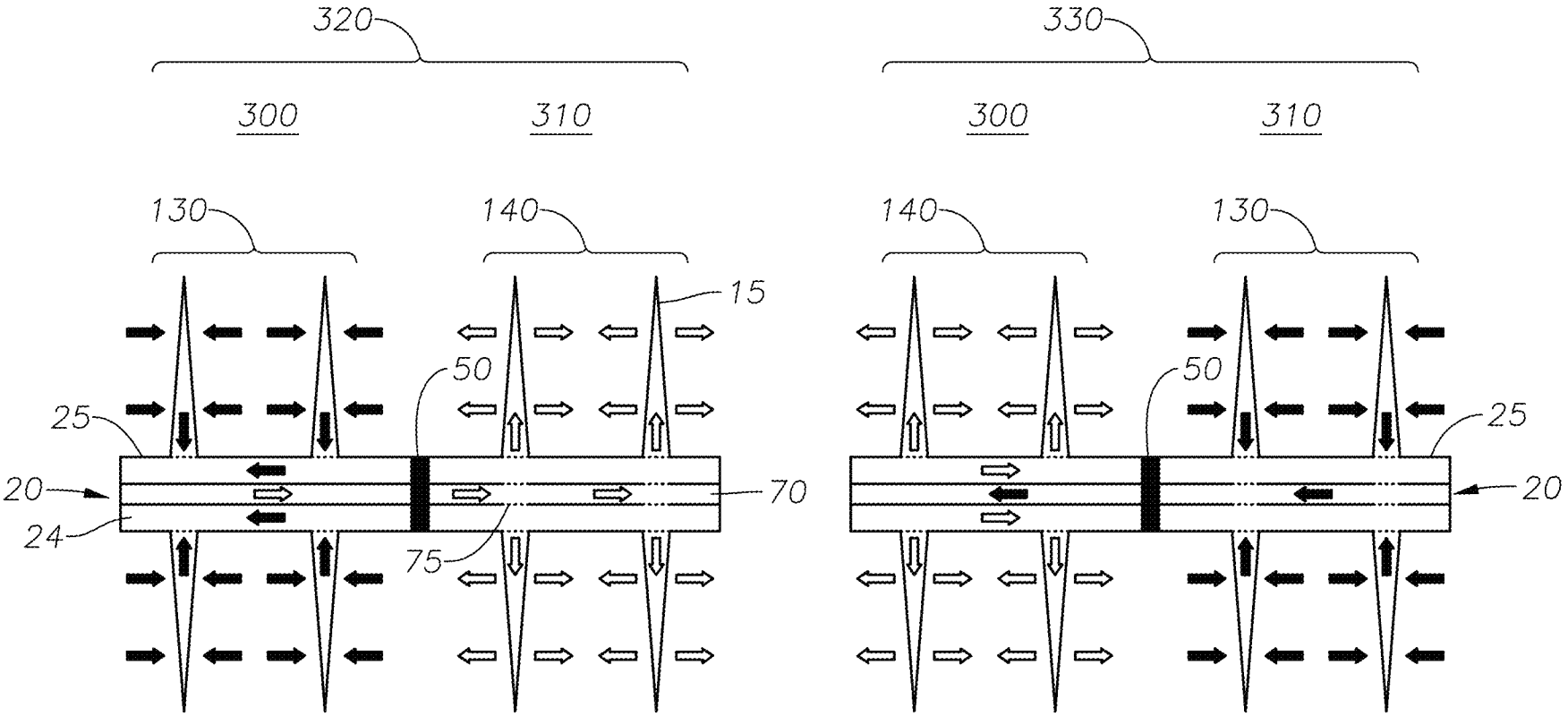
FIG. 7B provides an embodiment of a production mode

FIG. 7B provides an alternate view of the cycling mode of operation. In an embodiment described with reference to FIG. 5B, fluid tubing 70 contains fluid perforations 75 in beta group 310. Fluid tubing 70 is in the absence of fluid perforations 75 in alpha group 300. During first mode of operation 320, injection fluid 210 is injected through fluid tubing 70. Injection fluid 210 flows out of fluid tubing 70 through fluid perforations 75 and into hydraulic fractures 15 in injection group 140. Injection fluid 210 drives reservoir fluid 220 in formation 10 to hydraulic fractures 15 in alpha group 300, where reservoir fluid 220 can flow into annulus 24 in wellbore 20. Reservoir fluid 220 can flow through annulus 24 to the surface. After the run time, second mode of operation 330 is initiated. During second mode of operation 330 injection fluid 210 is injected through annulus 24. Injection fluid 210 flows from annulus 24 out through hydraulic fractures 15 into formation 10. Injection fluid 210 in formation 10 drives reservoir fluid 220 in formation 10 toward hydraulic fractures 15 in beta group 310. Reservoir fluid 220 from formation 10 enter wellbore 20 through hydraulic fractures 15. Reservoir fluid 220 enters fluid tubing 70 through fluid perforations 75 and flows to the surface.

Advantageously, the method and systems described here require only one hydraulically fractured wellbore. The methods and systems described here are in the absence of a second hydraulically fractured wellbore. The casing is in the absence of a dividing wall. The tubing is in the absence of a dividing wall.

EXAMPLES

Example. Simulation models of a hydraulically fractured horizontal well were prepared to compare a concurrent strategy of fluid injection and production of reservoir fluid to conventional strategies, including primary depletion and gas huff-n-puff. The formation was a shale oil reservoir. The reservoir permeability was set to 100 nanoDarcys (nD) and the formation permeability in SRV was set to 500 nD. Case 1 was a simulation of a conventional strategy of primary depletion. In case 1 the well is depleted at a constant bottomhole pressure ($(P_{bh})_{prod}$) for 20 years. All segments along the trajectory are producing. Case 2 was a simulation of a conventional strategy referred to as huff-n-puff. In case 2, carbon dioxide was injected through all of the segments along the trajectory into the formation. The injection step was at a constant bottomhole pressure $(P_{bh})_{inj}$ set to be about 20% greater than initial reservoir pressure ($P_{Ri}$). The injection step continued for three months. Then the injection step was terminated and a production step was initiated. During the production step, oil is produced from all of the segments at a constant $(P_{bh})_{pro}$d for three months. The cycle of injection step and production step was repeated for 20 years. Case 3 was a simulation of concurrent fluid injection and production of reservoir fluid described here, where the production configuration had alternating segments and the production mode was a single mode of operation. In case 3, carbon dioxide as the injection fluid was injected through the injection segments at a constant $(P_{bh})_{inj}$. Oil was produced as the reservoir fluid through the production segments at a constant $(P_{bh})_{prod}$. Both injection and production were simulated simultaneously and the process was continued for a simulated 20 years.

Figure 8:
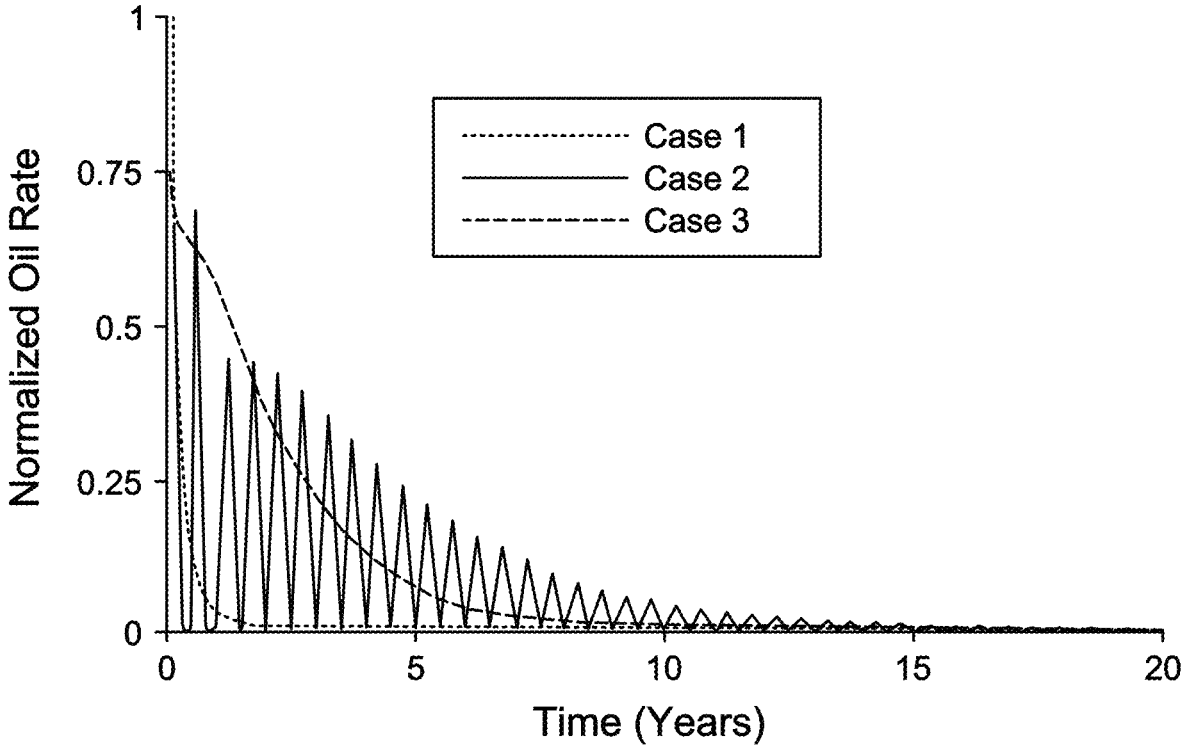
FIG. 8 is a graphical representation of normalized oil rates for the Example.

In each of the cases, the $(P_{bh})_{prod}$ was the same and was maintained above the bubble point pressure to prevent two phase flow in the reservoir. Additionally, the $(P_{bh})_{inj}$ was the same in each case. The oil flow rates for each case were normalized to the initial oil flow rate of case 1 as shown in FIG. 8. The cumulative oil production for all cases was normalized to the simulated cumulative oil recovery of case 1 at 20 years as shown in FIG. 9.

Figure 9:
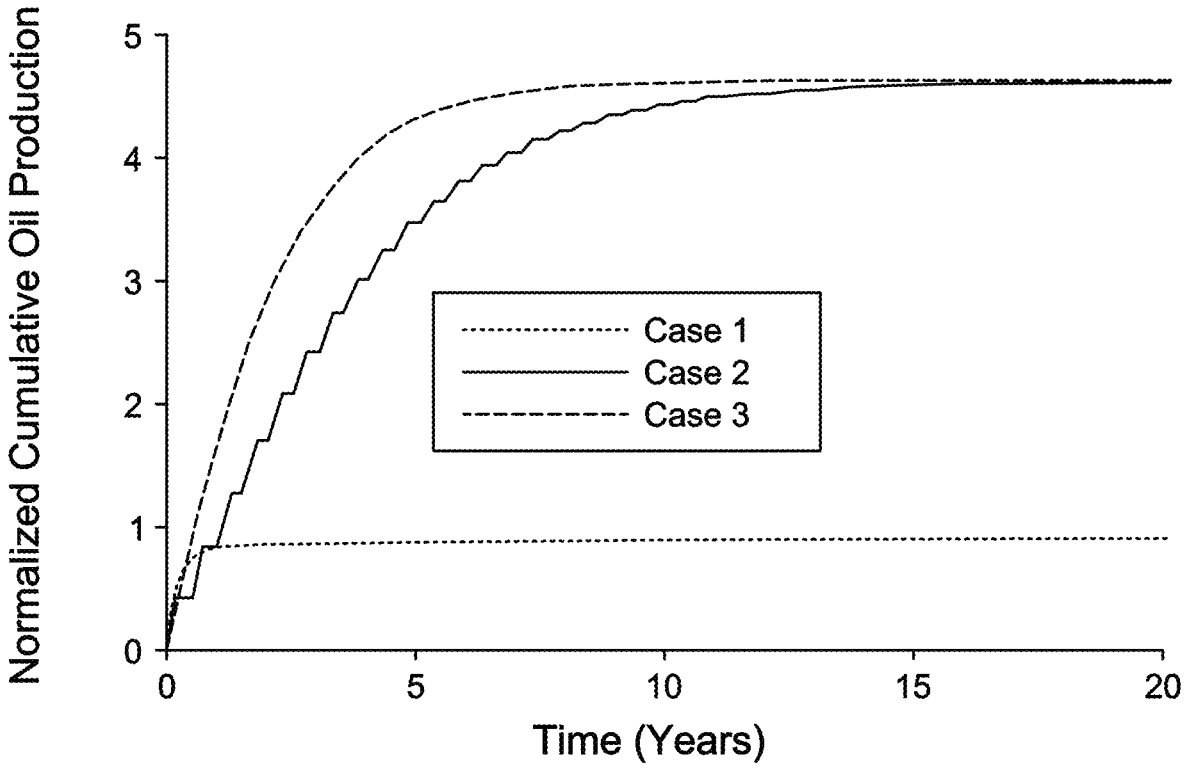
FIG. 9 is a graphical representation of the normalized cumulative oil production for the Example.

As can be in FIG. 8, although the initial oil rate for case 1 was greater than the initial oil rate for case 2 or case 3, after the 20 year simulated period the cumulative production is significantly less in case 1 than the cumulative production for Case 2 or Case 3 as shown in FIG. 9. The strategies simulated in Case 2 and Case 3 performed better than the primary depletion of Case 1. The concurrent fluid injection and production of a reservoir fluid of Case 3 had an oil recovery of about 4.5 times that of the primary depletion of Case 1. Geomechanical effects, such as opening and closing hydraulic fractures with depletion and injection cycles, were not modeled in the simulations, thus the results exhibited minimal difference in estimated ultimate recovery (EUR) after 20 years of production for Case 2 and Case 3. The EUR is the amount of oil or gas expected to be economically recovered from a reservoir or field by the end of its producing life. FIG. 8 and FIG. 9 show that the primary benefit of the concurrent fluid injection and production of a reservoir fluid of Case 3 is the accelerated production. After 2 years of production, the cumulative oil production in Case 3 is about 2.9 times larger than the cumulative oil production of Case 1 and about 1.2 times larger than the cumulative oil production of Case 2. This corresponds to a 70% improvement in oil production in the first two years in the concurrent fluid injection and production of reservoir fluid of the systems and methods described here (Case 3) as compared to a conventional huff-n-puff strategy (Case 2). In the first 5 years cumulative oil production of case 3 is about 25% larger than oil production in case 2. Thus, the simulation results show that oil production in case 3 is accelerated as compared to case 2.

Figure 10:
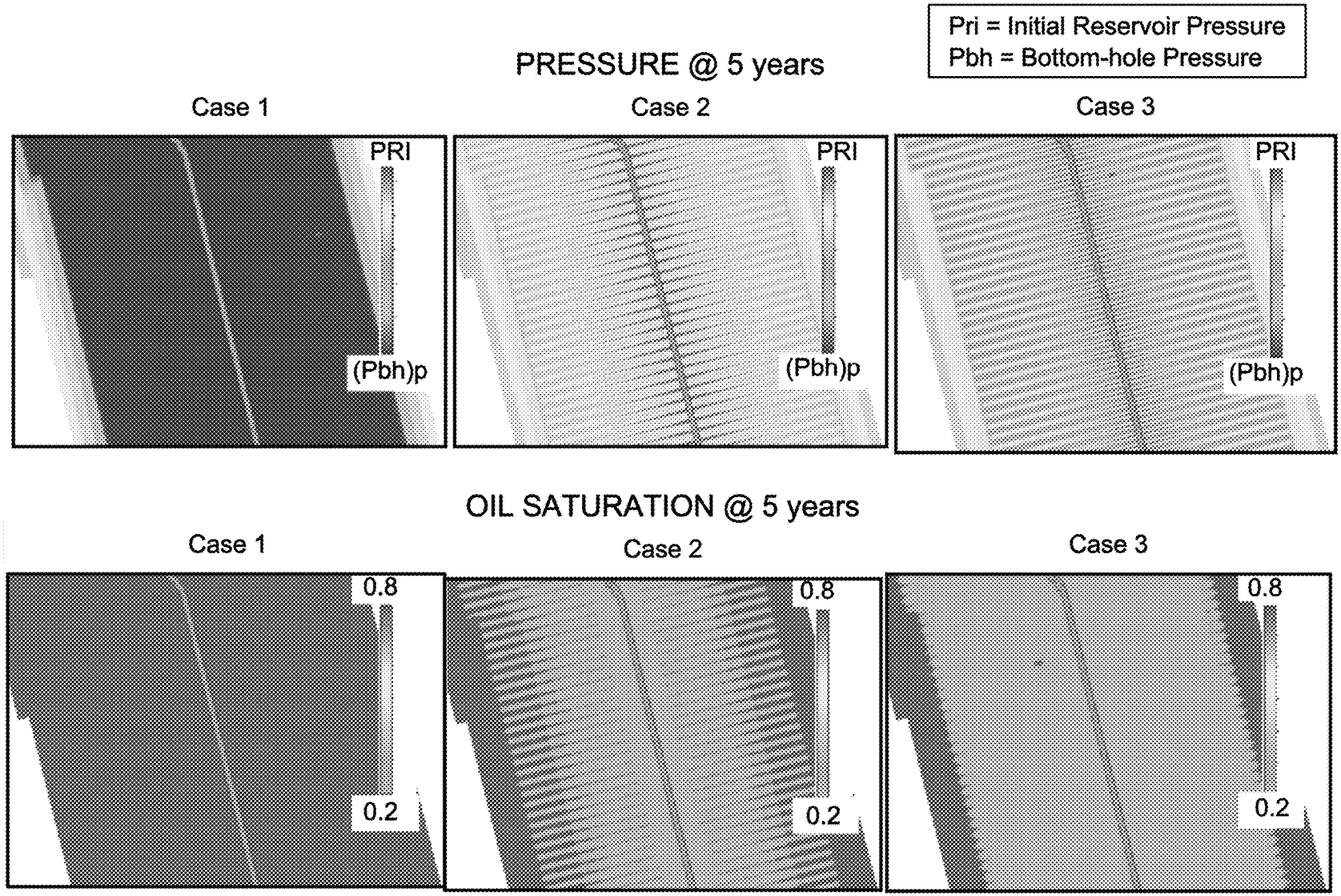
FIG. 10 is a graphical representation of the pressure and oil saturation at 5 years for the Example.

FIG. 10 shows the pressure and oil saturation maps after 5 simulated years for each of the cases. The pressure map for Case 1 shows that pressure in the SRV is depleted more (as shown by the dark gray color everywhere in the SRV, which corresponds to the produced bottomhole pressure, $(P_{bh})_{prod}$ after 5 years of production) than that for Case 2 and Case 3. The remaining oil saturation in SRV for Case 1 is larger than for Case 2 and Case 3 (illustrated by the dark gray throughout the image). The results presented in FIG. 10 also confirm that the cumulative oil recovery for Case 1 is lower compared to Case 2 and Case 3. In addition, FIG. 10 shows that oil in SRV is swept better in Case 3 (illustrated in by the medium gray area indicating low oil saturation is larger compared to Case 2) than that of the oil in Case 2, which explains the accelerated oil production for Case 3 compared to Case 2 in FIG. 9. The results indicating improved sweep efficiency further confirm the accelerated oil production of Case 3.

Although the embodiments have been described in detail, it should be understood that various changes, substitutions, and alterations can be made hereupon without departing from the principle and scope. Accordingly, the scope of the embodiments should be determined by the following claims and their appropriate legal equivalents.

There various elements described can be used in combination with all other elements described here unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed here as from about one particular value to about another particular value and are inclusive unless otherwise indicated. When such a range is expressed, it is to be understood that another embodiment is from the one particular value to the other particular value, along with all combinations within said range.

As used here and in the appended claims, the words "comprise," "has," and "include" and all grammatical variations thereof are each intended to have an open, non-limiting meaning that does not exclude additional elements or steps.

That which is claimed is:

1. A method for concurrent fluid injection and production of a reservoir fluid from a hydraulically fractured horizontal well, the method comprising the steps of:

completing a well in a formation to create the hydraulically fractured horizontal well, wherein the well extends from a surface through the formation, the hydraulically fractured horizontal well comprises:

a wellbore extending into the formation, the wellbore having a trajectory through the formation, hydraulic fractures extending from the wellbore into the formation, the hydraulic fractures in fluid communication with the formation and with the wellbore, a casing defining an interior of the wellbore, the casing comprising casing perforations such that the casing perforations extend through the casing in fluid communication between the hydraulic fractures and the interior of the wellbore, where the hydraulic fractures fluidly connect the interior of the wellbore and the formation, packers, the packers separating the wellbore into two or more segments such that the packers prevent fluid communication between each segment, wherein each segment comprises one or more hydraulic fractures, an injection tubing extending from the surface through the interior of the casing, through the packers, and through the segments, wherein the injection tubing comprises injection perforations in each segment, wherein an injection flow control instrument is configured to adjust flow through the injection perforations, and a production tubing extending from a surface through the interior of the casing, through the packers, and through the segments, wherein the production tubing comprises production perforations in each segment, wherein a production flow control instrument is configured to adjust flow through the production perforations;

designating an alpha group, wherein the alpha group comprises one or more segments;

designating a beta group, wherein the beta group comprises one or more segments such that each segment is in either the alpha group or the beta group, wherein the number and location of the segments in each of the alpha group and the beta group are based on the production configuration;

initiating a first mode of operation comprising the steps of:

opening the injection flow control instruments on the injection tubing in the alpha group, wherein the alpha group comprises injection segments during the first mode of operation, and opening the production flow control instruments on the production tubing in the beta group, wherein the beta group comprises production segments during the first mode of operation;

operating the hydraulically fractured horizontal well in the first mode of operation for a first mode run time comprising the steps of:

injecting an injection fluid through the injection tubing in the alpha group, maintaining the injection of the injection fluid such that the injection fluid flows from the injection tubing through the injection flow control instruments to the interior of the casing, maintaining the injection of the injection fluid such that the injection fluid flows from the interior of the casing through the hydraulic fractures into the formation, driving the reservoir fluid from the formation to hydraulic fractures in the beta group due to the flow of the injection fluid, receiving the reservoir fluid through the hydraulic fractures into the interior of the casing, removing the reservoir fluid through the production flow control instruments to the production tubing, and removing the reservoir fluid through the production tubing of the beta group to the surface;

stopping the first mode of operation comprising the steps of:

closing the injection flow control instruments in the alpha group at the completion of the run time, and closing the production flow control instruments in the beta group at the completion of the run time;

initiating a second mode of operation comprising the steps of:

opening the production flow control instruments in the alpha group, wherein the alpha group comprises production segments during the second mode of operation, and opening the injection flow control instruments in the beta group, wherein the beta group comprises injection segments during the second mode of operation;

operating the hydraulically fractured horizontal well in the second mode of operation for a second mode run time comprising the steps of:

injecting an injection fluid through the injection tubing in the beta group, maintaining the injection of the injection fluid such that the injection fluid flows from the injection tubing through the injection flow control instruments to the interior of the casing, maintaining the injection of the injection fluid such that the injection fluid flows from the interior of the casing through the hydraulic fractures into the formation, driving the reservoir fluid from the formation to hydraulic fractures in the production segments due to the flow of the injection fluid, receiving the reservoir fluid through the hydraulic fractures into the interior of the casing, removing the reservoir fluid through the production flow control instruments to the production tubing, and removing the reservoir fluid through the production tubings of the alpha group to the surface; and cycling between the first mode of operation and the second mode of operation for a production time.

2. The method of claim 1, wherein the injection flow control instrument is selected from the group consisting of inflow control devices, inflow control valves, and combinations of the same, and wherein the production flow control instrument is selected from the group consisting of inflow control devices, inflow control valves, and combinations of the same.

3. The method of claim 1, wherein the injection fluid is selected from the group consisting of water, brine, carbon dioxide, reservoir gases, reservoir fluids, flue gas, air, and combinations of the same.

4. The method of claim 1, wherein the injection fluid comprises an additive, the additive selected from the group consisting of surfactants, polymers, solvents, nano-particles, and combinations of the same.

5. The method of claim 1, wherein the reservoir fluid is selected from the group consisting of liquid hydrocarbons, natural gas, water, brine, and combinations of the same.

6. The method of claim 1, further comprising one or more pressure gauges installed along the production tubing and configured to measure pressure in the production tubing, and further comprising one or more pressure gauges installed along the injection tubing configured to measure a pressure in the injection tubing.

7. The method of claim 1, wherein the packers are selected from the group consisting of production packers, inflatable packers, and combinations of the same.

8. The method of claim 1, wherein the production configuration is alternating segments such that each of the one or more injection segments is bordered by a production segment.

9. The method of claim 1, further comprising the steps of:

collecting in real time distributed wellbore data from one or more instrument installed in the hydraulically fractured horizontal well during the first mode of operation, wherein the one or more instruments are selected from the group consisting of temperature gauges, pressure gauges, acoustic measuring devices, and combinations of the same;

adding the distributed wellbore data to a reservoir simulation model during the first mode of operation;

running the reservoir simulation model to create a simulated result; and adjusting the first mode run time based on the simulated result.

10. The method of claim 1, further comprising the steps of:

collecting in real time distributed wellbore data from one or more instrument installed in the hydraulically fractured horizontal well during the second mode of operation, wherein the one or more instruments are selected from the group consisting of temperature gauges, pressure gauges, acoustic measuring devices, and combinations of the same;

adding the distributed wellbore data to a reservoir simulation model during the second mode of operation;

running the reservoir simulation model to create a simulated result; and adjusting the second mode run time based on the simulated result.

11. A method for concurrent fluid injection and production of a reservoir fluid, the method comprising the steps of:

completing a well in a formation to create a hydraulically fractured horizontal well, wherein the well extends from a surface through the formation, the hydraulically fractured horizontal well comprises:

a wellbore extending into the formation, the wellbore having a trajectory through the formation, hydraulic fractures extending from the wellbore into the formation, the hydraulic fractures in fluid communication with the formation and with the wellbore, a casing defining an interior of the wellbore, the casing comprising casing perforations such that the casing perforations extend through the casing in fluid communication between the hydraulic fractures and the interior of the wellbore, where the hydraulic fractures fluidly connect the interior of the wellbore and the formation, a packer, wherein the packer separates the wellbore into an alpha group and a beta group, wherein the packer is configured to prevent fluid communication between each group, wherein the beta group is farther along the trajectory from the surface than the alpha group, wherein each group comprises a segment, wherein each segment comprises one or more hydraulic fractures, a fluid tubing extending from the surface through the interior of the casing, through the alpha group, through the packer into the beta group and through the beta group along the trajectory, wherein the fluid tubing comprises fluid perforations in the beta group, and an annulus defined by the space between the casing and the fluid tubing in the alpha group;

operating the hydraulically fractured horizontal well in a first mode of operation for a first mode run time comprising the steps of:

injecting an injection fluid through the fluid tubing, maintaining the injection of the injection fluid such that the injection fluid flows from the fluid tubing through the fluid perforations in the beta group, maintaining the injection of the injection fluid such that the injection fluid flows through the hydraulic fractures in the beta group into the formation, driving the reservoir fluid from the formation to hydraulic fractures in the alpha group due to the flow of the injection fluid, receiving the reservoir fluid through the hydraulic fractures into the annulus of the alpha group, and removing the reservoir fluid through the annulus to the surface;

stopping the first mode of operation;

initiating a second mode of operation;

operating the hydraulically fractured horizontal well in the second mode of operation for a second mode run time comprising the steps of:

injecting an injection fluid through the annulus of the alpha group, maintaining the injection of the injection fluid such that the injection fluid flows from the annulus through the hydraulic fractures in the alpha group and into the formation, driving the reservoir fluid from the formation to hydraulic fractures in the beta group due to the flow of the injection fluid, receiving the reservoir fluid through the hydraulic fractures into the interior of the casing, and removing the reservoir fluid through the fluid perforations in in the fluid tubing in the beta group and to the surface; and cycling between the first mode of operation and the second mode of operation for a production time.

12. The method of claim 11, wherein the injection fluid is selected from the group consisting of water, brine, carbon dioxide, reservoir gases, reservoir fluids, flue gas, air, and combinations of the same.

13. The method of claim 11, wherein the reservoir fluid is selected from the group consisting of liquid hydrocarbons, natural gas, water, brine, and combinations of the same.

14. The method of claim 11, further comprising a pressure gauge configured to measure a pressure in the fluid tubing.

15. The method of claim 11, further comprising a pressure gauge configured to measure a pressure in the annulus.

16. The method of claim 11, wherein the packer is selected from the group consisting of a production packers, an inflatable packer, and combinations of the same.

17. The method of claim 11, further comprising the steps of:

collecting in real time distributed wellbore data from one or more instrument installed in the hydraulically fractured horizontal well during the first mode of operation, wherein the one or more instruments are selected from the group consisting of temperature gauges, pressure gauges, acoustic measuring devices, and combinations of the same;

adding the distributed wellbore data to a reservoir simulation model during the first mode of operation;

running the reservoir simulation model to create a simulated result; and adjusting the first mode run time based on the simulated result.

18. The method of claim 11, further comprising the steps of:

collecting in real time distributed wellbore data from one or more instrument installed in the hydraulically fractured horizontal well during the second mode of operation, wherein the one or more instruments are selected from the group consisting of temperature gauges, pressure gauges, acoustic measuring devices, and combinations of the same;

adding the distributed wellbore data to a reservoir simulation model during the second mode of operation;

running the reservoir simulation model to create a simulated result; and adjusting the second mode run time based on the simulated result.

* * * * *